US005077899A

United States Patent [19]

Rancour et al.

[11] Patent Number: 5,077,899

[45] Date of Patent: Jan. 7, 1992

[54] FIBERGLASS PANEL CUTTER WITH INTERLOCKING BLADES

[75] Inventors: James K. Rancour, St. Cloud; John F. Wozniak, Cokate, both of Minn.

[73] Assignee: Malco Products, Inc., Arnandale, Minn.

[21] Appl. No.: 622,945

[22] Filed: Dec. 6, 1990

Related U.S. Application Data

[63] Continuation-in-part of Ser. No. 444,534, Dec. 1, 1989, Pat. No. 5,040,297.

[51] Int. Cl.[5] ..... B26B 29/00

[52] U.S. Cl. ..... 30/287; 30/280; 83/875

[58] Field of Search ..... 30/287, 278, 279.2, 30/280, 296.1, 299, 303; 83/875, 745

[56] References Cited

U.S. PATENT DOCUMENTS

| | | | |
|---|---|---|---|
| 332,305 | 12/1885 | Traut . | |
| 547,829 | 10/1895 | Williams . | |
| 635,983 | 11/1899 | Hanson . | |
| 752,532 | 2/1904 | Draughon et al. . | |
| 1,012,591 | 12/1911 | Bodmer et al. . | |
| 1,026,053 | 5/1912 | Saner . | |
| 1,176,355 | 3/1916 | Fitzwater . | |
| 1,696,552 | 12/1928 | Org . | |
| 1,846,180 | 2/1932 | Black . | |
| 2,436,111 | 2/1948 | Lowe . | |
| 2,650,532 | 9/1953 | Moldowan | 30/299 |
| 2,735,455 | 2/1956 | Forsberg . | |
| 2,869,599 | 1/1949 | Palm . | |
| 3,124,176 | 3/1964 | Vogini . | |
| 3,206,702 | 9/1965 | Greenwood . | |
| 3,242,780 | 3/1966 | Ried et al. . | |
| 3,274,868 | 9/1966 | Williams . | |
| 3,420,142 | 1/1969 | Gale et al. . | |
| 3,515,019 | 6/1970 | Tyer, Jr. . | |
| 3,596,356 | 6/1971 | O'Neal | 30/280 |
| 3,605,534 | 9/1971 | Barr . | |
| 3,866,265 | 2/1975 | Beazley . | |
| 3,875,835 | 4/1975 | Roberts . | |
| 3,935,767 | 2/1976 | McClay, Jr. . | |
| 3,941,018 | 3/1976 | Williams . | |
| 3,996,824 | 12/1976 | Cailey . | |
| 4,070,954 | 1/1978 | Cailey . | |
| 4,091,697 | 5/1978 | Cailey . | |
| 4,128,030 | 12/1978 | Kindikoff . | |
| 4,180,908 | 1/1980 | Beerman | 30/287 |
| 4,224,854 | 9/1980 | Malacheski et al. . | |
| 4,286,384 | 9/1981 | Kotchy | 30/299 |
| 4,379,419 | 4/1983 | Woock et al. . | |
| 4,411,183 | 10/1983 | Auer . | |
| 4,584,772 | 4/1986 | Bergler . | |
| 4,608,902 | 9/1986 | Ivey . | |
| 4,983,081 | 1/1991 | Cunningham, Jr. . | |

OTHER PUBLICATIONS

A one-page brochure on the PC-36 Portable Fiber Glass Closure Machine.

A one-page brochure entitled "A new look to an old Master: the E215-T".

A one-page brochure on the GM 300 Grooving Machine.

A one-page brochure entitled "New! The FabMaster System".

An eight-page brochure entitled "Step-By-Step Guide To Using the FabMaster Hand-Groove Ductboard System: . . . ".

A one-page brochure on the Glass-Master "48" fabrication machine.

A one-page brochure entitled "Groov-Master E215-T Call for the Workhorse . . . ".

(List continued on next page.)

*Primary Examiner*—M. Rachuba

*Attorney, Agent, or Firm*—Palmatier & Sjoquist

[57] ABSTRACT

A blade for cutting a groove in ductboard and forming a corresponding scrap strip of ductboard. The blade includes two blade portions depending from a support member such as a hand tool with a sled for engaging the ductboard. Each of the blade portions includes an inner end which engages the other inner end to partially fix the blades relative to each other and partially restrict the blades from spreading which may be caused by the horizontal grain of ductboard.

20 Claims, 3 Drawing Sheets

OTHER PUBLICATIONS

A one-page brochure entitled "The Auto-Groover: Computer controlled fiberglass duct maker".

A one-page brochure entitled "Fabrication Accessories".

A 12-page brochure entitled "Fabrication Manual".

A two-page brochure entitled "Glass Master Contract Prices".

A three-page Amcraft Inc. brochure entitled "Amcraft Kerfing Tools for Fabrication of Glass Fiber Ducts".

A Carter Donlevy Co. brochure entitled "Celco Duct Square".

A Miami Air Conditioning Inc. 3-page brochure entitled "Instructions for Fiber Board Duct Ruller".

A 5-page Amcraft Inc. brochure entitled "Amcraft Kerfing Tools for Fabrication of Glass Fiber Ducts".

FIBERGLASS PANEL CUTTER WITH INTERLOCKING BLADES

This application is a continuation-in-part of patent application Ser. No. 444,534, filed Dec. 1, 1989 now U.S. Pat. No. 5,040,297.

BACKGROUND OF THE INVENTION

The present invention relates to tools for cutting grooves in ductboard and, more particularly, to hand tools for cutting grooves in ductboard.

Fiberglass ductboard is typically utilized for the construction of air ducts. The fiberglass ductboard arrives at construction sites in four foot by eight foot, four foot by ten foot, or eight foot by eight foot panels. Grooves are then cut into the ductboard so that the ductboard may be bent and shaped into box-like air ducts.

Fiberglass ductboard is typically one inch or one and one-half inches thick and includes an aluminum foil or staple flap layer on one side. Grooves are often cut in the fiberglass within 1/16th of an inch of the foil layer, or right down to the foil layer without a piercing of the foil.

A standard fiberglass cutting tool for cutting grooves in ductboard typically includes two blade portions lying transversely of each other. In the cutting process, the blades may be forced apart such that the cut groove is imperfect with odd pieces of ductboard that are chiseled out.

Three different forces may cause the transverse separation which results in the incomplete cut. One force may be the horizontal grain of the fiberglass ductboard that runs along or generally parallel to the plane in which the ductboard lies. Ductboard is formed of planar sheets of fiberglass which in the final product form an undulating pattern while running generally parallel to the plane of the board. The blades tend to follow the grain and be drawn toward and away from a surface of the ductboard. When the blades are drawn as such, the blades also deflect or swing transversely as they are fixed relative to the tool. The deflection or separation of the blades causes the incomplete cut.

Another force that may cause such an incomplete cut is the beveled feature of the cutting edges on the blades. The beveled cutting edge may act like a frontwardly disposed rudder permanently fixed to steer the blades transversely apart from one another.

A third force is the deflector tab as shown and described in the parent application Ser. No. 444,534 filed Dec. 1, 1989. As the extractor tabs direct a scrap strip of ductboard from the groove, the strip brings a return pressure to bear on the tab which may cause deflection or separation of the blades.

SUMMARY OF THE INVENTION

A feature of the present invention is the provision in a blade for cutting a groove in ductboard, of a pair of blade portions with cutting edges and depending from a support member such as a hand tool and wherein the blade portions have inner ends engaging each other to partially fix the blade portions relative to each other and partially restrict the blade portions from spreading.

Another feature is the provision in such a blade, of blade portions configured to cut a shiplap groove wherein one of the blade portions includes a generally vertical blade section having a notch and the other blade section is horizontal and engages the notch such that the horizontal blade section is somewhat restricted from vertical movement or deflection relative the vertical blade section.

Another feature is the provision in such a blade, of blade portions configured to cut a V-groove wherein the blade portions depend obliquely of a support member such as a hand tool and obliquely of each other and wherein one of the inner, lower ends of the blade portions include a slot and the other inner, lower end tapers and extends through the slot to partially fix the blade portions relative to each other and partially restrict the blade portions from spreading.

Another feature is the provision in such a blade, of blade portions configured to cut a female shiplap groove in both frontward and rearward directions and wherein one of the blade portions includes a generally vertical blade section having a slot and the other blade portion includes a generally horizontal blade section which tapers and extends through the slot such that the horizontal blade section is somewhat restricted from vertical movement or deflection relative to the vertical blade section.

Another feature is the provision in such a blade with interlocking blade portions, of extractor tabs on the interlocking blade portions to extract scrap strips of ductboard from the grooves being cut by the interlocking blade portions.

An advantage of the present invention is the easy and quick formation of smooth, continuous grooves in ductboard which are cut independently of the grain of the ductboard, the beveled cutting edges, or the extractor tabs.

Another advantage is a more durable, strong blade for cutting grooves in ductboard. Standard fiberglass panel cutting hand tools have blades which depend from the sled of the tool. Thus, when not in use, such a tool is typically set on a surface such that its blade bears much of the weight of the tool, as shown in FIG. 1. Therefore, with the present interlocking blades, a separation and subsequent misalignment of the blade portions is less likely because the blade portions interlock and thus lend support to one another.

DETAILED DESCRIPTION OF THE PREFERRED EMBODIMENT

Figure 1:
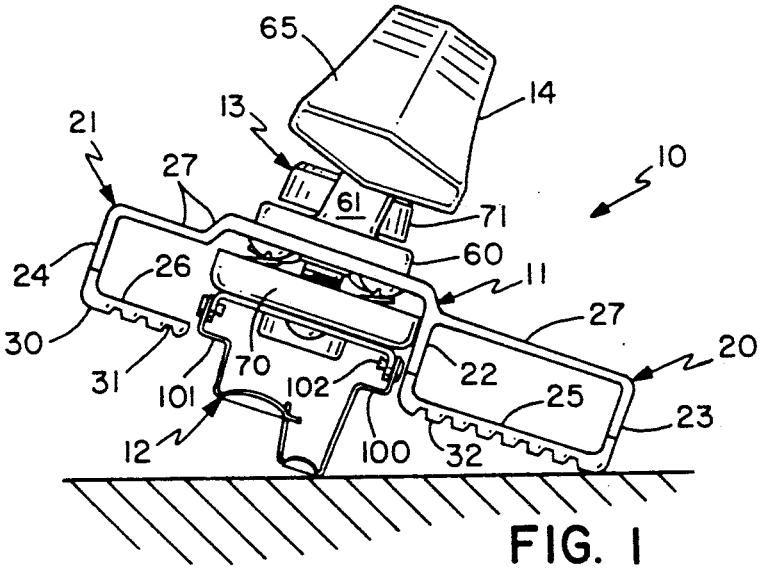
FIG. 1 is a front elevation view of the present fiberglass panel cutter.
Figure 2:
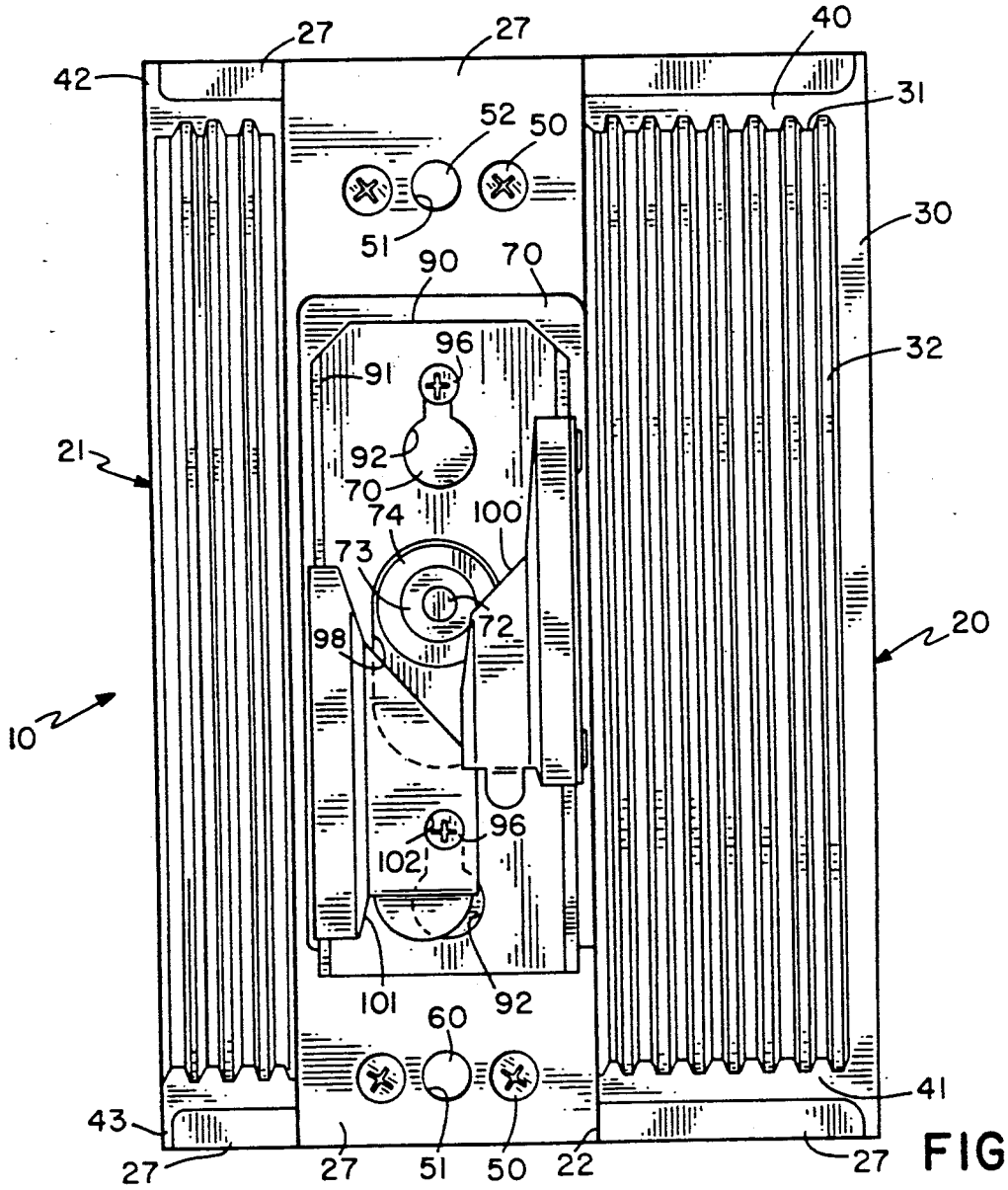
FIG. 2 is a bottom plan detail view of the fiberglass panel cutter of FIG. 1.

As shown in FIGS 1 and 2, the present fiberglass panel cutter is indicated in general by the reference numeral 10. It includes as its principal components a sled or housing 11, an interlocking blade 12 for cutting a right hand shiplap groove, a blade height adjusting means 13 for adjusting the height of the blade 12, and a handle 14.

The sled or housing 11 includes a box-like portion 20 and a U-shaped portion 21 and is formed of an extruded anodized aluminum. Box-like portion 20 includes an inner abutment wall 22. The box-like and U-shaped portions 20 and 21 include respective outer walls 23 and 24 and respective lower plates 25 and 26. Each of the portions 20 and 21 includes an upper plate 27.

Each of the lower plates 25, 26 includes a lower surface 30 for bearing against a fiberglass panel. The lower surface 30 includes a plurality of linear channels 31 and corresponding linear ridges 32 formed or extruded transversely in the plates 24, 26. The channels 31 decrease resistance of the fiberglass panel as the sled 11 is slid across the panel. The channels 31 and ridges 32 also serve to guide the sled 11 along a straight line as a groove is being formed.

Each of the plates 25, 26 include respective front and rear tapering edges 40, 41 to facilitate the sliding of the plates 24, 26 across a panel. Each of the outer walls 23, 24 also include front and rear tapering edges 42, 43 which are formed linearly with the edges 40, 41.

Each of the ends of the upper plate 27 of the sled 11 includes a pair of holes for receiving screws 50 for mounting the handle 14. Each of the ends of the upper plate 27 also include a nub receiving aperture 51 for receiving a nub 52 formed integrally with the handle 14. The nub 52 is a locating feature for ease of assembly and conversion to the opposite hand fabrication method.

The handle 14 includes integral mounts 60 having threaded reinforced retainers or inserts for receiving screws 50. The handle 14 also includes arms 61 extending upwardly and being canted relative the mounts 60 and lower surface 30. The arms 61 typically extend at an acute angle of about 10° relative the lower surface 30, but may extend at an angle between about 5° and 20°. The handle 14 is reversible via the mounts 60 which are interchangeable to accommodate both left handed and right handed operators.

A handle 14 further includes an integral handgrip portion 65 which extends between the arms 61. The handgrip portion 65 is canted about 10° relative the lower surface 30 of the sled 11, but is mounted symmetrically relative the arms 61. The handgrip portion 65 is somewhat diamond-shaped in cross section from end to end.

The blade height adjusting means 13 includes a plastic blade mount 70 and a hand knob 71 having a fixed threaded shaft 72. The shaft 72 cooperates with the blade mount 70 via threaded reinforced retainers or inserts 73 fixed in the mount 70. One of the retainers 73 is set in a lower boss 74 formed integrally with the mount 70. It should also be noted that blade mount 70 bears against inner wall 22 of sled box-like portion 20 to maintain the blade mount 70 and blade 12 parallel relative to the linear channels of the bottom surface 30. The blade mount 70 is drawn incrementally up or down relative the upper plate 27 and lower surface 30 when the knob 71 is turned.

The blade 12 includes an upper blade plate or support 90 and a pair of opposing integral side lips 91. The blade support 90 includes keyhole-like apertures 92. Screws 96 fasten the blade support 90 to the blade mount 70. Screws 96 cooperate with the retainers or threaded inserts fixed in the mount 70. The blade support 90 also includes a larger slot 98 for receiving the boss 74 of the blade mount 70. The blade support 90 is removable from the mount 70 by slightly loosening the screws 96 and sliding the blade support 90 forwardly until the screws 96 are receivable through the circular portion of the keyhole like apertures 92.

It should be noted that the blade support 90 is retained on the blade mount 70 even if, for instance, the screws 96 are somewhat loose. The screws 96 bear against the front edges of the slotted portions of apertures 92 when the blade support 90 is biased toward the rear, such as when the cutter 10 is being pushed forwardly in a cutting operation.

The blade 12 includes two blade portions 100, 101. Each of the blade portions 100, 101 is secured to the lips 91 of the blade support 90 via rivets 102. Blade portion 101 includes an aperture 102 aligned with one of the screws 96 for receiving a screwdriver to turn screw 96.

As shown in FIGS. 2–5, blade portion 100 of the blade 12 includes an outer, upper end 110 secured to the lip 91 of the support member 90 via rivets 102. A generally U-shaped integral bent plate section 111 includes a plate section 112 extending integrally downwardly and inwardly from upper end 110, a horizontal plate section 113 running generally parallel to support member 90, and an oblique plate section 114 extending upwardly and inwardly from horizontal plate section 113. Each of the front plate sections 112, 113 and 114 include a front continuous beveled cutting edge 115. The rear edge of horizontal plate section 113 includes a raised extractor tab 116. Oblique plate section 114 includes a rear edge 117 with a notch 118 running in from the rear edge 117 and disposed generally parallel to the support member 90. The notch 118 includes a blade bearing or engaging shoulder 119.

The blade portion 101 includes an outer, upper end 120 secured to the lip 91 of the support member 90 via rivets 102. A generally L-shaped or right angled bent plate section 121 is integrally formed with end 120 and includes a generally vertical plate section 122 extending downwardly from end 120 and being slightly oblique relative support member 90. A horizontal plate section 123 extends inwardly from the lower end of plate 122. An inner portion 124 of the horizontal plate section 123 engages and extends into the notch 118. Each of the plate sections 122, 123 have a front continuous beveled cutting edge 125. The rear edge of horizontal plate section 123 includes a raised extractor tab 126.

In operation, the blade portions 100, 101 of blade 12 cooperate to cut a right hand shiplap groove. As the blade portions 100, 101 travel across a ductboard panel, beveled cutting edges 115, 125 and extractor tabs 116, 123 may cause transverse deflection of the blade portions relative each other. However, such deflection is minimal as the bottom surface of beveled cutting edge 125 of inner portion 124 almost immediately is brought to bear on the shoulder 119 of the notch 118. Such an engagement of plate section 123 with plate section 114 partially restricts vertical movement of plate section 123 relative the plate section 114 and relative the support member 90. Some vertical movement of plate section 123 may occur because of the resiliency of blade portion 100, but such movement is typically minimal. Such engagement also restricts a spreading of the blade portions 100, 101 relative to each other or a swinging of the blade portions 100, 101 relative their upper ends 110, 120.

One force that tends to cause the swinging or spreading of the blade portions 100, 101 is the horizontal grain of the ductboard. It should be noted that the extractor tabs 116, 126 may also tend to cause the blade portions 100, 101 to swing apart and that the engagement of blade sections 114, 123 counteracts the swinging. As the extractor tabs 116, 126 direct a scrap strip of ductboard from the groove being cut, the scrap strip also brings return pressure to bear on the tabs 116, 126 and their blade sections 114, 123 to cause deflection of the blade portions 100, 101. Another force may be the beveled edges of the cutting edges 115, 125 which may tend to cause a spreading or swinging without the engagement of end 124 in notch 118.

Figure 3:
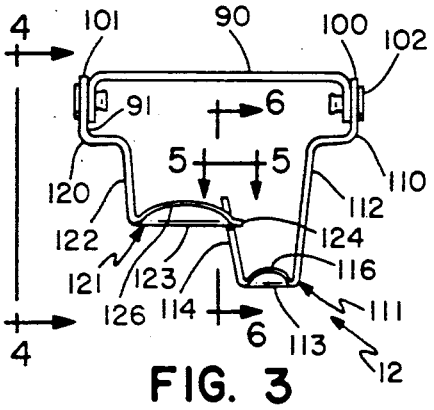
FIG. 3 is a front elevation view of the blade of FIG. 1 for cutting a right hand shiplap groove.
Figure 4:
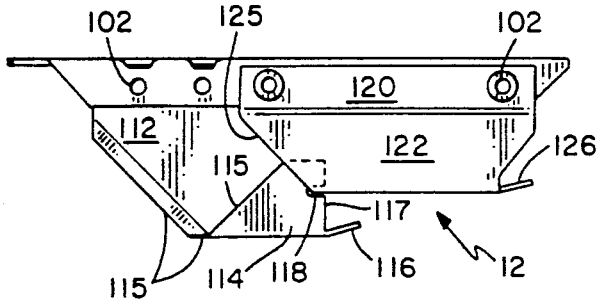
FIG. 4 is a side elevation view of the blade at lines 4—4 of FIG. 3.
Figure 7:
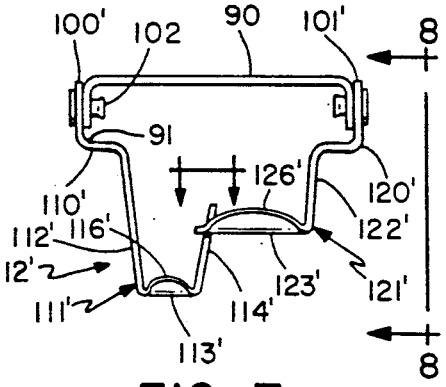
FIG. 7 is a front elevation view of a blade for cutting a left hand shiplap groove and for connection to the tool of FIGS. 1 and 2.
Figure 8:
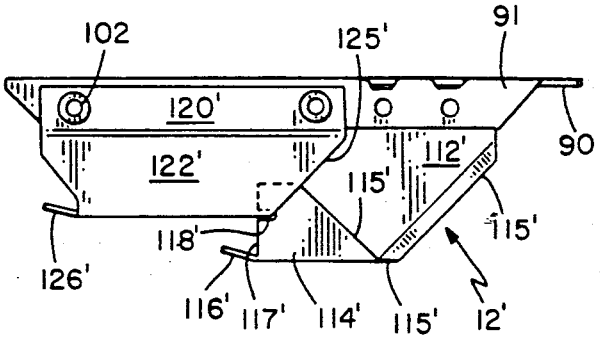
FIG. 8 is a side elevation view of the blade at lines 8—8 of FIG. 7.
Figure 5:
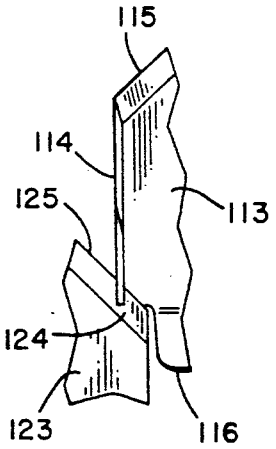
FIG. 5 is a detail view at lines 5—5 of FIG. 3.
Figure 6:
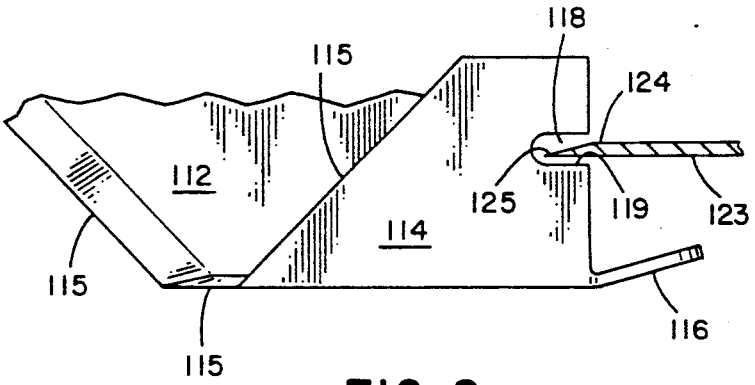
FIG. 6 is a detail view at lines 6—6 of FIG. 3.

Whereas the blade 12 shown in FIGS. 3–5 cuts a right hand shiplap groove, the blade 12′ shown in FIGS. 6–8 cuts a left hand shiplap groove. Blade 12′ is a mirror image of blade 12 and includes such corresponding components which are indicated by the prime marks (′).

Figure 9:
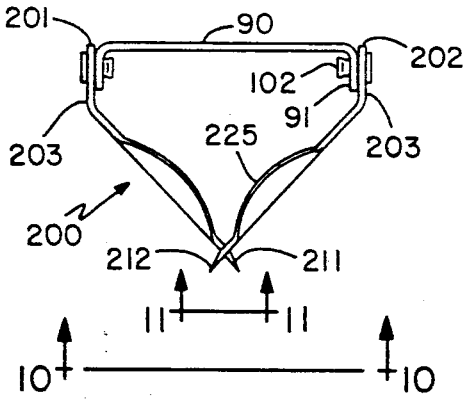
FIG. 9 is a front elevation view of a blade for cutting a V-groove and for connection to the tool of FIGS. 1 and 2.
Figure 10:
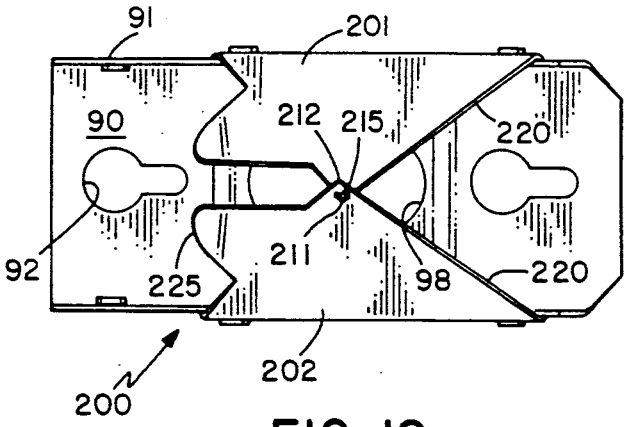
FIG. 10 is a side elevation view of the blade at lines 10—10 of FIG. 9.
Figure 11:
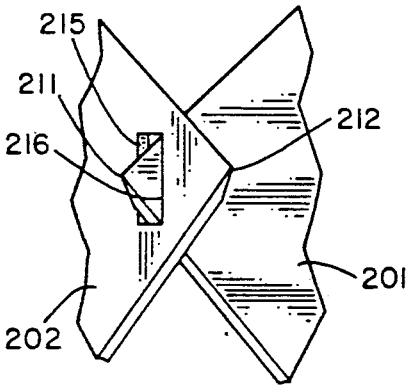
FIG. 11 is a detail view at lines 11—11 of FIG. 9.

As shown in FIGS. 9–11, a blade 200 for cutting a V-groove in ductboard includes blade portions 201, 202 depending from support member 90. Each of the blade portions 201, 202 includes an upper, outer end 203 secured to lips 91 of the support member 90 via the rivets 102. From the outer ends 203, the blade portions 201, 202 extend toward each other where the blade portions 201, 202 include respective tapering, engaging, inner ends 211, 212. Inner end 212 includes a slot 215 through which tapered ends 211 extends. Slot 215 includes a blade bearing or engaging lower shoulder 216. Each of the portions 201, 202 includes a beveled cutting edge 220 and raised extractor tab portion 225 transversely of the cutting edges 220.

In operation, the engaging inner ends 211, 212 minimize a spreading of the blade portions 201, 202 as a groove is cut. Although the horizontal grain of ductboard tends to have more of an affect on right hand and left hand shiplap blades 12, 12′ than the V-blade 200, the engagement of ends 211, 212 still provides a truer V-cut as it minimizes a swinging of the blade portions 201, 202 relative each other and relative their respective outer ends 203. As with blade 12, the engagement of the ends 211, 212 counteracts a spreading of the blade portions 201, 202 which may be caused by the beveled edges 220 or the extractor tabs 225 directing a scrap strip of ductboard from its corresponding groove.

Figure 12:
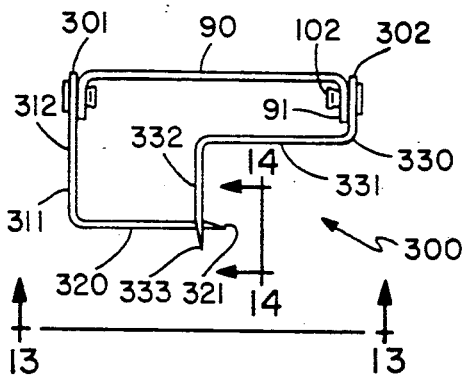
FIG. 12 is a front elevation view of a blade for cutting a shiplap groove and for connection to the tool of FIG. 1 and 2.
Figure 13:
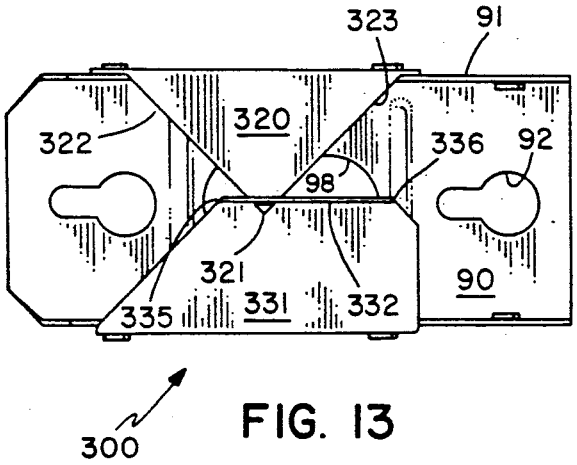
FIG. 13 is a side elevation view of the blade at lines 13—13 of FIG. 12.
Figure 14:
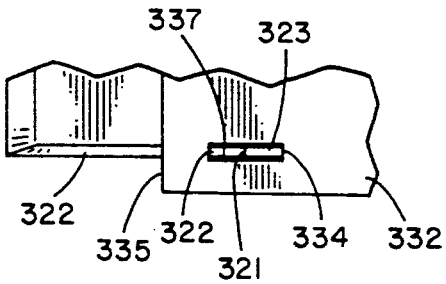
FIG. 14 is a detail view at lines 14—14 of FIG. 12.

As shown in FIGS. 12–14, a blade 300 for cutting a female shiplap groove along an edge of a ductboard includes blade portions 301, 302. Blade portion 301 is generally L-shaped and includes an upright blade section 311 with an upper outer end 312 secured to one of the lips 91 of support member 90 via the rivets 102. A blade section 320 extends integrally at generally a right angle from the lower end of blade section 311 and includes a tapering inner end 321. Blade section 320 runs generally parallel to support member 90. Blade section 320 includes respective front and rear beveled cutting edges 322, 323.

Blade portion 302 includes an upper outer end 330 secured to one of the lips 91 of support member 90 via the rivets 102. A horizontal blade section 331 extends integrally inwardly from end 330 and runs generally parallel to support member 90. A generally upright blade section 332 extends downwardly at generally a right angle from the inner end of horizontal blade section 331 and includes a tapered inner end 333 with a slot 334. Tapered end 321 extends through the slot 334. Blade section 332 includes respective front and rear beveled cutting edges 335, 336. Slot 334 is formed in part by a lower blade bearing or engaging shoulder 337.

In operation, blade end 321 engages the shoulder 337 of the slot 334 as the blade portions 301, 302 are deflected away from each other. Such an engagement of the ends 321, 333 minimizes vertical movement of horizontal blade section 320 relative to vertical blade section 332 and relative to the support member 90. The engagement of ends 321, 333 also minimizes a spreading of the blade portions 301, 302 or a swinging of the blade portions relative each other and their respective upper, secured ends 312, 330. The horizontal grain of ductboard or the beveled cutting edges 335, 336 may cause such spreading or swinging.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hand tool for cutting a groove in a ductboard and forming a corresponding scrap strip of ductboard, comprising a support member, and a pair of blade portions with cutting edges and depending from the support member, the blade portions extending toward each other and having inner and outer ends, each of the outer ends secured to the support member, the inner ends engaging each other to partially fix the blade portions relative to each other and partially restrict the blade portions from spreading.

2. A hand tool according to claim 1, wherein one of the inner ends includes a notch and the other inner end engages the notch.

3. A hand tool according to claim 1, wherein the inner ends are oblique relative to each other and one of the inner ends is generally parallel to the support member.

4. A hand tool according to claim 1, wherein one of the blade portions comprises a blade plate bent into generally an L-shape and the other blade portion comprises another blade plate bent into generally a U-shape to cut a shiplap groove.

5. A hand tool according to claim 1, wherein one of the inner ends includes a slot and the other inner end tapers and extends through the slot.

6. A hand tool according to claim 1, wherein the inner ends are oblique relative to each other and to the support member.

7. A hand tool according to claim 1, wherein the blade portions form a V-shape for cutting a V-groove.

8. A hand tool according to claim 1, wherein the inner ends form generally a right angle relative to each other, one of the inner ends being generally parallel to the support member and the other inner end being generally perpendicular to the support member.

9. A hand tool according to claim 1, wherein each of the blade portions comprise a blade plate bent into the shape of an L for cutting a female shiplap groove along an edge of the ductboard.

10. A hand tool according to claim 1, wherein each of the blade portions includes front and rear edges, the front edges including the cutting edges and at least one of the rear edges including a raised portion bent inwardly to partially extract the ductboard strip from the ductboard during the cutting of a groove.

11. A hand tool according to claim 1, wherein each of the blade portions includes front and rear edges, the cutting edges being disposed on portions of both of the front and rear edges.

12. A hand tool according to claim 1, wherein the support member comprises a hand tool, the hand tool comprising a sled for engaging the ductboard and a handle mounted on the sled for manipulating the tool, the blade portions secured to and depending from the sled.

13. A hand tool for cutting grooves in ductboard and forming corresponding scrap pieces of ductboard, comprising a support member comprising a sled having a lower surface for engaging the ductboard, a handle mounted on the support member for manipulating the tool, a pair of blade portions depending from the support member, each of the blade portions including a front cutting edge and a rear raised portion for extracting the scrap pieces of ductboard, and one of the blade portions including a generally L-shaped portion and the other blade portion including a generally U-shaped portion such that the blade portions cooperate to cut a shiplap groove, the L-shaped blade portion including a parallel inner end, the U-shaped blade portion including an oblique inner end oblique of the parallel inner end and including a notch, the parallel inner end engaging the notch to partially fix the blade portions relative to each other and partially restrict the blades from spreading.

14. A hand tool for cutting grooves in ductboard and forming corresponding scrap pieces of ductboard, comprising a support member comprising a sled having a lower surface for engaging the ductboard, a handle mounted on the support member for manipulating the tool, a pair of blade portions depending from the support member, each of the blade portions including a front cutting edge and a rear raised portion for extracting the scrap pieces of ductboard, and the blade portions depending obliquely of the lower surface and obliquely of each other such that the blade portions form a V-shape and cooperate to cut a V-groove, each of the blade portions including an inner, lower end, one of the ends including a slot and the other end tapering and protruding through the slot to partially fix the blade portions relative to each other and partially restrict the blades from spreading.

15. A hand tool for cutting grooves in ductboard and forming corresponding scrap pieces of ductboard, comprising a support member comprising a sled having a lower surface for engaging the ductboard, a handle mounted on the support member for manipulating the tool, a pair of blade portions depending from the support member, each of the blade portions including a front cutting edge and a rear raised portion for extracting the scrap pieces of ductboard, and each of the blade portions including a generally L-shaped portion, one of the blade portions including a parallel plate running parallel to the lower surface of the sled and the other blade portion including a vertical plate at a right angle to the parallel plate such that the blade portions cooperate to cut a female shiplap groove, each of the plates having an inner end, the inner end of the vertical plate including a slot and the inner end of the parallel plate tapering and protruding through the slot to partially fix the blade portions relative to each other and partially restrict the blades from spreading.

16. A hand tool to travel across a ductboard panel and produce a groove therein, comprising a support member, a pair of blade portions on the support member and oriented to lie along in the direction of travel and transversely of each other, and said blade portions comprising cutting edges to sever the ductboard during such travel, and the blade portions having traversing portions engaging each other and restraining the blade portions against deflection in a direction transversely of the direction of travel.

17. A hand tool according to claim 16, wherein at least one of the blade portions comprises a pair of blade portions oriented transversely of each other.

18. A hand tool according to claim 16, wherein said traversing portions having interlocking means retraining said deflection.

19. A hand tool according to claim 16, wherein one of said traversing portions comprises a shoulder surface oriented transversely of a cutting edge and confronting the other of said traversing portions.

20. A hand tool according to claim 16, wherein one of said traversing portions comprising a notch receiving the other of said traversing portions therein.

* * * * *

UNITED STATES PATENT AND TRADEMARK OFFICE

CERTIFICATE OF CORRECTION

PATENT NO. : 5,077,899

DATED : Jan. 7, 1992

INVENTOR(S) : James K. Rancour and John F. Wozniak

It is certified that error appears in the above-identified patent and that said Letters Patent is hereby corrected as shown below:

On the title page, in item [73], "Arnandal" should be --Annandale--.

Signed and Sealed this

Third Day of November, 1992

*Attest:*

*Attesting Officer*

DOUGLAS B. COMER

*Acting Commissioner of Patents and Trademarks*